US006142045A

United States Patent [19]

Coxe

[11] Patent Number: 6,142,045

[45] Date of Patent: Nov. 7, 2000

[54] ABRASIVE DISC CUTTING APPARATUS AND METHOD

[76] Inventor: Howard Coxe, P.O. Box 373, Independence, Va. 24348

[21] Appl. No.: 08/736,443

[22] Filed: Oct. 24, 1996

[51] Int. Cl.[7] ..... B26D 7/06

[52] U.S. Cl. ..... 83/23; 83/202; 83/649

[58] Field of Search ..... 83/23, 202, 649; 76/101.1

[56] References Cited

U.S. PATENT DOCUMENTS 3,688,622 9/1972 Wahnschaff ..... 83/649 X
4,034,634 7/1977 Arbter ..... 83/649 X
4,138,913 2/1979 Gentile ..... 83/202 X
5,647,261 7/1997 Wierrenga ..... 83/649

*Primary Examiner*—Douglas D. Watts

[57] ABSTRACT

An apparatus and method of cutting abrasive discs from an eight inch wide or smaller roll of abrasive material that is automated, lightweight, and economical. After a disc is cut by steel rule die punch assembly, a web from the roll pulls the cut disc over a cut out where it falls to be collected, the cut disc is assisted by a material removal mechanism, the process then repeats itself.

2 Claims, 1 Drawing Sheet

ABRASIVE DISC APARATUS
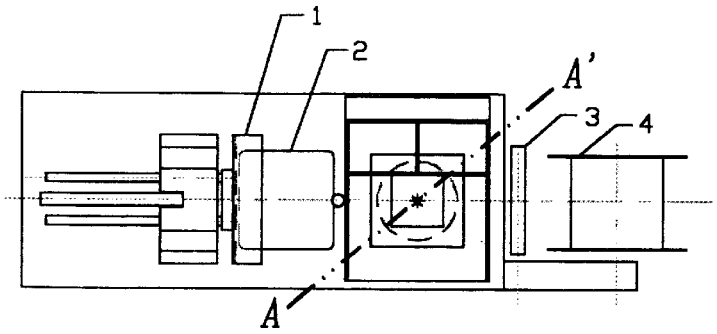
Fig. 1 PLAN VIEW & CROSS SECTION LOCATION
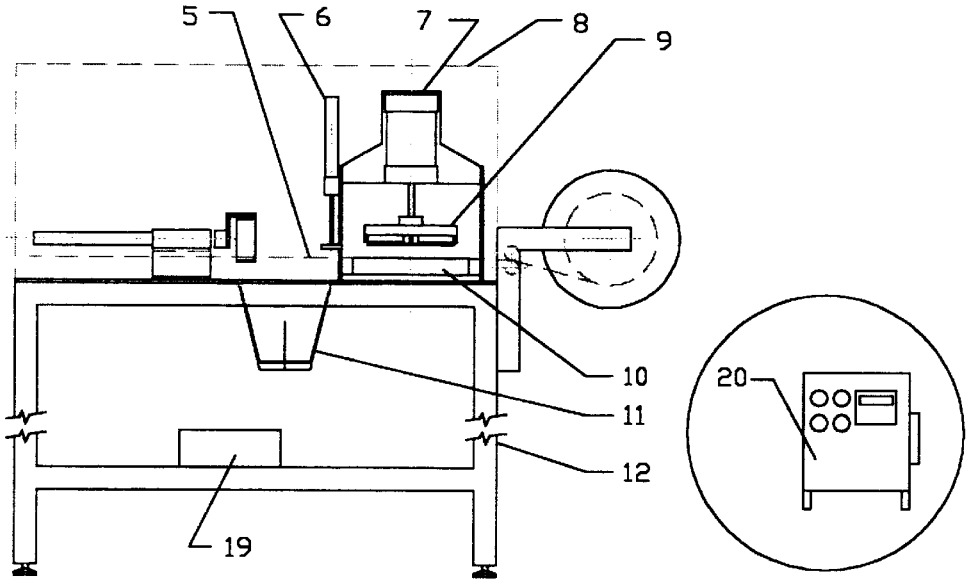
Fig. 2 FRONT ELEVATION & RIGHT ELEVATION INSET
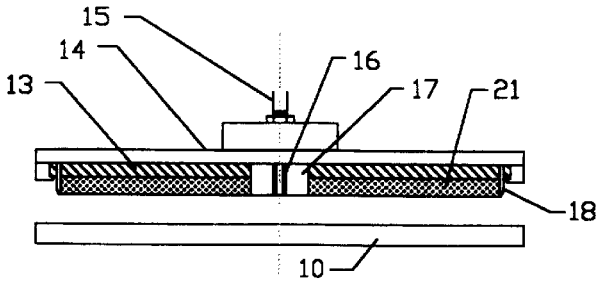
Fig. 3 CROSS SECTION A–A'

ABRASIVE DISC CUTTING APPARATUS AND METHOD

BACKGROUND FIELD OF INVENTION

The present invention relates in general of a device for forming abrasive discs from an eight inch or smaller roll of abrasive material and in particular to apparatus and method for forming and separating abrasive discs.

Heretofore, abrasive discs used in sanding operations have been available to independent wood finishing contractors from only a few large companies having huge equipment available to manufacture said abrasive discs. This has led to a limited number of suppliers.

U.S. Pat. No. 5,035,684 to Sorrells (1991) is for the assembly and method of obtaining perforated standard sheet sand paper for use on powered pad sanders having spaced suction holes in its platen. A number of powered sanders do not incorporate suction holes and have a need not for rectangle, square, or roll abrasive, but for abrasive discs.

Many wood-finishing contractors have objected because of the economical disadvantages of a limited number of suppliers for abrasive discs. Contractors want to use their in-house work force more efficiently, which they could do if they had the means to their supplies internally. This is most important in view of the national slew economical trend in the particular trade at this time.

Accordingly, several objects and advantages of my invention are:

(a) to provide an apparatus and method to allow contractors to have supervised automated cutting and separating of particular sizes of abrasive discs from rolls of abrasive material in-house supplies, thus resulting in an ecounomical advantage to said contractors.

(b) to provide an apparatus and method to allow said contractors to use in house work force in this endeavor, thus giving their laborers an economical advantage by providing work conditions that will be more consistent in its hours, (c) to provide an apparatus and method to allow an unlimited number of suppliers of abrasive discs.

(d) to provide an apparatus and method whose ease of use, plus lightweight and simplified construction will be available to a large number of contractors, which again will allow a significant economical advantage to the contractor.

Further objects and advantages of my invention will become apparent from a consideration of the drawings and ensuind description of it.

SUMMARY OF THE INVENTION

The foregoing, and additional objects are attained in accordance with the principles of this invention by providing an apparatus comprising; a support frame assembly, a steel rule die punch assembly, a disc cutting plate, a punch drive mechanism, a brake and slide assembly mechanism, a material removal mechanism, a pneumatic reservoir tank, and an electronic control board. As the apparatus is started the electronic control board controls air from the pneumatic reservoir to cause a web of abrasive material to be pulled by the brake and slide assembly mechanism under the steel rule die punch assembly, the punch drive mechanism drives the steel rule die punch assembly onto the web against the disc cutting plate, thus make a perforated cut of a disc. The brake and slide assembly mechanism then pulls the web and the cut disc over an opening in the support frame assembly whereon the cut disc falls into the exit chute assisted by the material removal mechanism. The process then repeats itself

BRIEF DESCRIPTION OF THE DRAWINGS

FIG. 1 is a top view of the apparatus constructed for this invention;

FIG. 2 is a side view of the apparatus constructed for this invention showing operation of this invention; and FIG. 3 is a longitudinal cross sectional view through a steel rule die punch assembly.

DETAILED DESCRIPTION

FIG. 1 illustrates a brake and slide assembly mechanism 1, a disc exit 2, a material guide rollers 3, and an eight inch wide or smaller roll of abrasive material 4. The brake and slide assembly mechanism 1 draws the abrasive material off the roll 4, through the material guide rollers 3, and eventually past the brake and slide assembly mechanism 1 to a point to the left of the mechanism.

FIG. 2 illustrates the brake and slide assembly mechanism 1, a material path 5, a material removal mechanism 6, a punch drive assembly 7, a safety shield 8, a steel rule die punch assembly 9, a roll of abrasive material 4, a disc cutting plate 10, a disc exit chute 11, a support frame assembly 12, a pneumatic reservoir tank 19, and an electronic control board 20 that is separate from the support frame assembly 12 and controls the automation of the apparatus. The roll of abrasive material 4 is manually pulled through the material guide rollers 3, between the steel rule die punch assembly 9 and the disc cutting plate 10, over the disc exit chute 11, through the brake and slide assembly mechanism 1. When the electronic control board 20 begins the automatic procedure, the punch drive assembly 7 presses the steel rule die punch assembly 9 against the disc cutting plate 10, thus cutting a disc. Then the brake and slide assembly mechanism 1 draws the material 4, through the material guide rollers 3, causing the cut disc to be pulled over the disc exit chute 11, the cut disc falls through a nine inch by eight inch cut out hole in the support frame assembly 12 into the disc exit chute 11, the disc is assisted in falling by the material removal mechanism 6. The procedure then continues to repeat allowing remaining, material 4 to proceed through the brake and slide assembly mechanism 1 off of the support frame assembly 12 to the left.

FIG. 3 illustrates a cross sectional of the steel rule die punch assembly 9. A cylinder rod 15 is attached to a backing plate 14. The backing plate 14 is made of steel material capable of supporting the steel rule die punch assembly 9 as it operates. A wooden, plastic, or metal punch plate assembly 13 is attached to the backing plate 14 and has attached to it the following; an optional center hole steel rule die 16, a steel rule die 17, consisting of several short pieces radiating out from the center hole steel rule die 16, a steel rule die 18 in a circular formation, a rubber material 21 that is embedded on steel rule die punch assembly 9 on an eight inch by eight inch wooden, plastic, or metal punch plate assembly 13 inside and outside the diameter of the steel rule die 18 for ejection of the cut disc. The optional center hole steel rule die 16, the steel rule die 17, and the steel rule die 18 are made of steel with a hardened edge. The optional center hole steel rule die 16 is located in the middle of the circular cut material with the steel rule die 17 radiating out from the center hole steel rule die 16. The diameter of the steel rule die 18 will determine the overall size of the cut disc. As the steel rule die punch assembly 9 is pressed against the disc cutting plate 10, the center hole steel rule die 16, the steel rule die 17, and the steel rule die 18 cut the abrasive material 4 into a cut disc.

Thus the reader will see that the steel rule die punch assembly provides a highly reliable, lightweight, yet economical device which can be used by laymen in the wood finishing profession.

While my above description contains many specificities, these should not be construed as limitations on the scope of the invention, but rather as an exemplification of one preferred embodiment thereof. Many other variations are possible. For example, the apparatus and method may be used manually or powered by differing power sources. One roll of abrasive material may be used at a time or up to two rolls may be used instead, offering a multitude of discs cut each time.

Accordingly, the scope of the invention should be determined not by the embodiment(s) illustrated, but by the appended claims and their legal equivalents.

I claim:

1. A method for preparing abrasive discs from a 8 inch by 50 yard roll of abrasive material comprising the steps of;

(a) providing a table support assembly, consisting of;
- a metal spool support that supports a 8 inch by 50 yard roll of abrasive material,
- a pair of stationary pinch rollers,
- a steel rule die punch assembly consisting of a punch actuator,
- an upper plate consisting of a circular steel rule die embedded on end into a 8 inch by 8 inch wood, metal, or plastic block with rubber (for ejection purposes) mounted inside and outside the blade diameter,
- a lower plate consisting of a cutting plate consisting of wood, metal, or plastic material to cut against,
- a disc exit chute consisting of a cut out in the table support assembly,
- a material removal actuator,
- a brake and slider assembly that consists of pneumatic actuators,
- a pneumatic reservoir tank having connecting means for operating various actuators,
- an electronic pneumatic control board for automating the above apparatus functions, (b) feeding the 8 inch wide abrasive material through the stationary pinch rollers, between the upper and lower plates of the steel rule punch die assembly, between the disc exit chute and the material removal actuator, through the brake and slider assembly, actuating the steel rule die assembly, wherein the punch actuator will press the upper plate against the lower plate thus cutting a disc out of the abrasive material, then the brake and slider assembly will pull the cut disc and surrounding abrasive material between the material removal actuator and the disc exit chute with the said actuator pushing the cut disc down through the disc exit chute to be collected as the steel rule die assembly will again perform the above said function.

2. An apparatus for preparing abrasive discs from a 8 inch wide or smaller roll of abrasive material comprising;

(a) a support frame assembly consisting of;
- a metal spool support that supports a 8 inch by 50 yard roll of abrasive material,
- a pair of stationary pinch rollers that keeps tension on said material,
- a steel rule die punch assembly consisting of
  - a punch actuator,
  - an upper plate consisting of a circular steel rule die embedded on end into a 8 inch by 8 inch wood, metal, or plastic block with rubber (for ejection purposes) mounted inside and outside the blade diameter,
  - a lower plate consisting of a cutting plate consisting of wood, metal, or plastic material to cut against,
- a disc exit chute consisting of a 9 inch by 9 inch cut out in the table support assembly,
- a material removal actuator,
- a brake and slider assembly that consists of pneumatic actuators for the purpose of moving the said material across the said support assembly,
- a pneumatic reservoir tank having connecting means for operating various said actuators mentioned above,
- an electronic pneumatic control board for automating all of the above functions.

* * * * *